US009518755B2

(12) United States Patent
Toya et al.

(10) Patent No.: US 9,518,755 B2
(45) Date of Patent: Dec. 13, 2016

(54) OUTDOOR UNIT FOR AIR-CONDITIONING APPARATUS, AND AIR-CONDITIONING APPARATUS

(71) Applicant: FUJITSU GENERAL LIMITED, Kawasaki-shi, Kanagawa (JP)

(72) Inventors: Kotaro Toya, Kawasaki (JP); Hideya Tamura, Kawasaki (JP); Takahiro Matsunaga, Kawasaki (JP); Shinju Watanabe, Kawasaki (JP); Takashi Kimura, Kawasaki (JP); Yasuhiro Oka, Kawasaki (JP); Ken Nakashima, Kawasaki (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 586 days.

(21) Appl. No.: 13/943,098

(22) Filed: Jul. 16, 2013

(65) Prior Publication Data

US 2014/0026603 A1 Jan. 30, 2014

(30) Foreign Application Priority Data

Jul. 30, 2012 (JP) ..... 2012-168066

(51) Int. Cl.

| | |
|---|---|
| ***F24F 11/02*** | (2006.01) |
| ***F25B 49/02*** | (2006.01) |
| ***F24F 1/00*** | (2011.01) |
| ***F24F 1/06*** | (2011.01) |
| ***F24F 3/06*** | (2006.01) |

(Continued)

(52) U.S. Cl.

CPC ..... *F24F 11/022* (2013.01); *F24F 1/0003* (2013.01); *F24F 1/06* (2013.01); *F24F 3/065* (2013.01); *F24F 11/001* (2013.01); *F24F 11/06* (2013.01); *F25B 49/02* (2013.01); *F24F 2011/0043* (2013.01); *F24F 2011/0045* (2013.01)

(58) Field of Classification Search

CPC ..... F24F 1/08; F24F 1/32; F24F 2001/0074; F24F 11/022

USPC ..... 165/300, 286

See application file for complete search history.

(56) References Cited

U.S. PATENT DOCUMENTS

| | | | | |
|---|---|---|---|---|
| 7,500,368 | B2 * | 3/2009 | Mowris | F25B 49/005 62/149 |
| 2006/0000224 | A1 * | 1/2006 | Matsuoka | F25B 13/00 62/114 |

(Continued)

FOREIGN PATENT DOCUMENTS

| | | | |
|---|---|---|---|
| CN | 101086372 | A | 12/2007 |
| CN | 101329093 | A | 12/2008 |

(Continued)

OTHER PUBLICATIONS

Chinese Office Action issued on Aug. 1, 2016 for the corresponding Chinese Patent Application No. 201310298501.8.

*Primary Examiner* — Devon Russell

(74) *Attorney, Agent, or Firm* — Rankin, Hill & Clark LLP

(57) ABSTRACT

An outdoor unit for an air-conditioning apparatus includes an outdoor heat exchanger; a compressor; a refrigerant pipe configured to couple the outdoor heat exchanger and the compressor with an indoor unit including an indoor heat exchanger; and a control unit that determines whether the heating capacity of the indoor unit performing a heating operation is decreased by the refrigerant stagnated in the indoor heat exchanger.

4 Claims, 2 Drawing Sheets

(51) Int. Cl.
*F24F 11/00* (2006.01)
*F24F 11/06* (2006.01)

(56) References Cited

U.S. PATENT DOCUMENTS

2008/0141524 A1* 6/2008 Yoshimi ..... F24F 1/26 29/726
2008/0229769 A1* 9/2008 Takegami ..... F25B 13/00 62/175
2009/0044550 A1* 2/2009 Nishimura ..... F25B 49/005 62/149
2010/0000245 A1* 1/2010 Kasahara ..... F25B 9/008 62/222
2010/0223940 A1* 9/2010 Kotani ..... F25B 45/00 62/149
2011/0000234 A1* 1/2011 Nishimura ..... F25B 49/005 62/77
2011/0011123 A1* 1/2011 Matsuura ..... C09K 5/045 62/468
2011/0083456 A1* 4/2011 Wakamoto ..... F25B 41/00 62/115
2011/0219804 A1* 9/2011 Park ..... F24F 1/26 62/259.1
2012/0000228 A1* 1/2012 Kinoshita ..... F25B 13/00 62/222
2012/0000553 A1* 1/2012 Matsuura ..... F24F 1/26 137/560
2013/0014525 A1* 1/2013 Koge ..... F25B 41/003 62/126
2013/0174594 A1* 7/2013 Yamashita ..... F24F 3/06 62/179
2013/0213083 A1* 8/2013 Higashiiue ..... F25B 5/04 62/500
2014/0083126 A1* 3/2014 Shimazu ..... F25B 1/00 62/324.6
2014/0090409 A1* 4/2014 Yamashita ..... F25B 9/006 62/196.1
2014/0150483 A1* 6/2014 Takayama ..... F25B 13/00 62/160
2014/0331702 A1* 11/2014 Tanaka ..... F25B 13/00 62/159
2015/0059380 A1* 3/2015 Takayama ..... F25B 13/00 62/222

FOREIGN PATENT DOCUMENTS

EP 2006615 A2 12/2008
JP 2004-286253 10/2004

* cited by examiner

OUTDOOR UNIT FOR AIR-CONDITIONING APPARATUS, AND AIR-CONDITIONING APPARATUS

CROSS-REFERENCE TO RELATED APPLICATION

This application is based on Japanese Patent Application No. 2012-168066 filed with the Japan Patent Office on Jul. 30, 2012, the entire content of which is hereby incorporated by reference.

BACKGROUND

1. Technical Field

The present disclosure relates to an outdoor unit for an air-conditioning apparatus, and an air-conditioning apparatus.

2. Related Art

Heretofore, an air-conditioning apparatus having at least one outdoor unit and a plurality of indoor units has been known. The indoor units are connected in parallel to the outdoor unit via a plurality of refrigerant pipes. The air-conditioning apparatus may be a so-called multi-air-conditioning apparatus in which all of the indoor units can perform a cooling operation or a heating operation simultaneously. The air-conditioning apparatus is capable of allowing the indoor units to be individually set to (or select) either a cooling operation or a heating operation and allowing them to be simultaneously operated (a so-called "cooling/heating-free operation").

Such an air-conditioning apparatus is described in, for example, JP-A-2004-286253 (Patent Document 1). This air-conditioning apparatus is provided with one outdoor unit, two indoor units, and two electromagnetic valve units. The outdoor unit is provided with a compressor, an accumulator, an oil separator, a receiver tank, and two outdoor heat exchangers. The outdoor unit also includes an outdoor expansion valve, a discharge valve, and an intake valve coupled to each of the outdoor heat exchangers. Each of the indoor units is provided with an indoor heat exchanger. Each of the electromagnetic valve units is provided with two electromagnetic valves. The electromagnetic valve units switch the couplings of the respective indoor heat exchangers to the discharge side (high-pressure side) of the compressor or the intake side (low-pressure side) of the compressor.

In the air-conditioning apparatus disclosed in Patent Document 1, the outdoor unit, the indoor units, and the electromagnetic valve units are coupled via refrigerant pipes as follows. A discharge pipe coupled to the discharge side of the compressor is coupled to the oil separator and branched therefrom. One branch pipe is coupled to the outdoor heat exchangers via the discharge valves. The other branch pipe is coupled to the indoor heat exchangers via the electromagnetic valve units. The discharge pipe and the branch pipes constitute a high-pressure gas pipe.

An intake pipe coupled to the intake side of the compressor is coupled to the accumulator and branched therefrom. One branch pipe from the accumulator is coupled to the outdoor heat exchangers via the intake valves. The other branch pipe from the accumulator is coupled to the indoor heat exchangers via the electromagnetic valve units. The intake pipe and the branch pipes constitute a low-pressure gas pipe.

The outdoor heat exchangers each have two coupling ports. To one of the coupling ports, the discharge valves and the intake valves are coupled. To the other of the coupling ports, one end of a branched refrigerant pipe is coupled via the outdoor expansion valves. The other end of the refrigerant pipe is coupled to the receiver tank and branched therefrom. The branch pipes from the receiver tank are coupled to the coupling ports of the indoor heat exchangers on the side on which the electromagnetic valve units are not coupled. The refrigerant pipe and the branch pipes constitute a liquid pipe.

In the air-conditioning apparatus described above, the coupling between the indoor heat exchangers and the compressor is switched by opening or closing the electromagnetic valves of the electromagnetic valve units. Namely, by opening or closing the electromagnetic valves, the coupling between the indoor heat exchangers and the discharge side or intake side of the compressor is switched. Thus, each of the indoor heat exchangers can be caused to individually serve as a condenser or an evaporator. Thus, the cooling operation or the heating operation can be selected for the individual indoor units while the indoor units are simultaneously operated.

SUMMARY

An outdoor unit for an air-conditioning apparatus includes an outdoor heat exchanger; a compressor; a refrigerant pipe configured to couple the outdoor heat exchanger and the compressor with an indoor unit including an indoor heat exchanger; and a control unit that determines whether the heating capacity of the indoor unit performing a heating operation is lowered by the stagnation of the refrigerant in the indoor heat exchanger.

DETAILED DESCRIPTION

Figure 1:
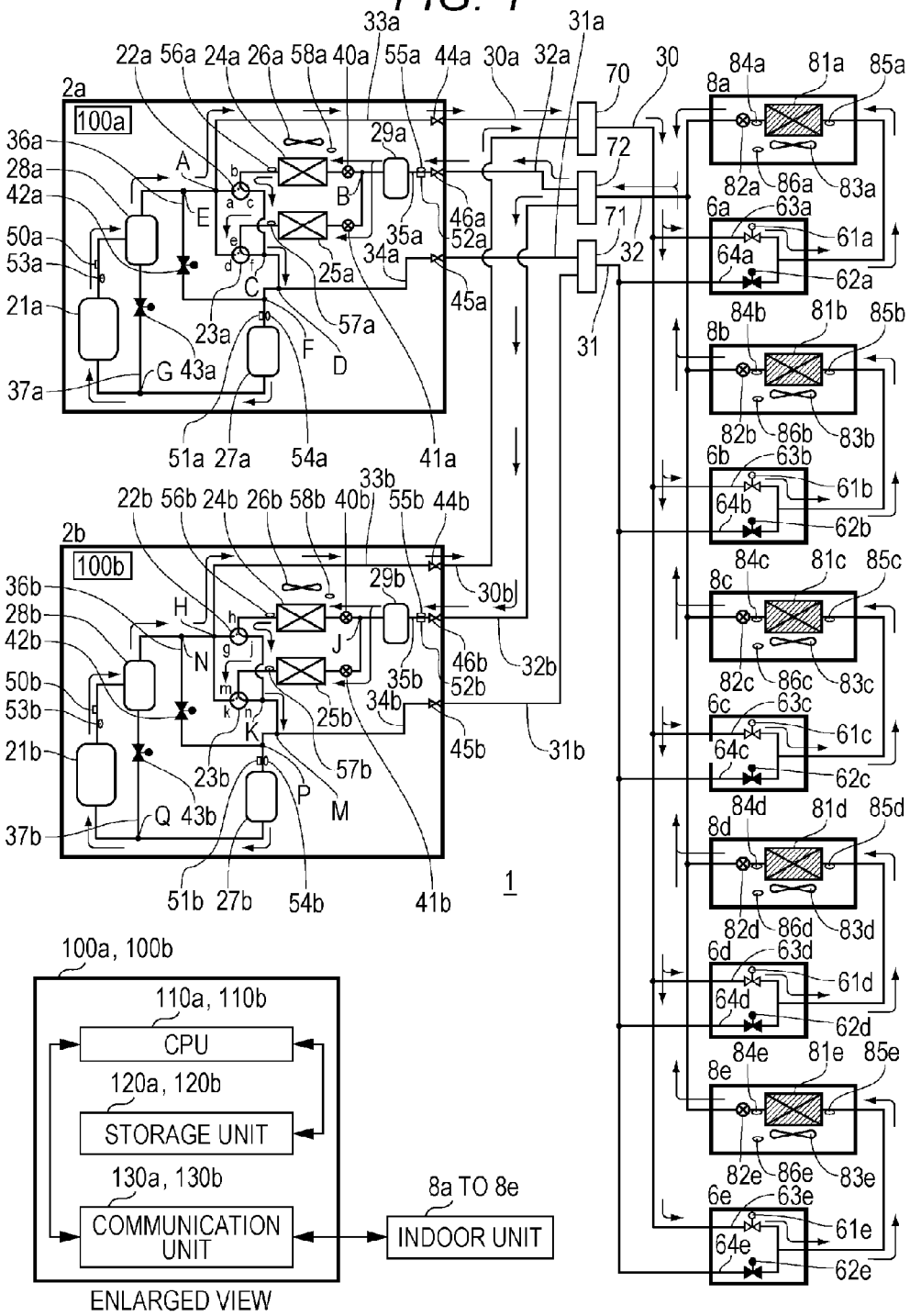
FIG. 1 is a refrigerant circuit diagram illustrating an air-conditioning apparatus according to an embodiment of the present disclosure, illustrating the flow of refrigerant during a heating operation.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In an air-conditioning apparatus such as discussed above, all (such as two) of the indoor units may perform the heating operation, or one indoor unit may perform the heating operation while the remaining indoor units may perform the cooling operation. In these cases, the capacity required from the indoor unit performing the heating operation may be greater than the capacity required from the indoor unit performing the cooling operation (hereafter referred to as a "heating-main operation"). In this case, the opening and closing of the various valves are controlled so that the outdoor heat exchangers can serve as evaporators.

When the air-conditioning apparatus performs the heating operation or the heating-main operation, the indoor heat exchangers serve as condensers. At this time, the degree of opening of indoor expansion valves corresponding to the indoor heat exchangers is controlled in accordance with the degree of subcooling of refrigerant at the refrigerant exit of the indoor heat exchangers, for example. The degree of subcooling of refrigerant can be determined by subtracting the refrigerant temperature at the refrigerant exit of the indoor heat exchangers from a high-pressure saturation temperature calculated on the basis of the pressure of refrigerant flowing in the high-pressure gas pipe (hereafter referred to as "the high pressure").

Specifically, the degree of opening of the indoor expansion valves is controlled so that the degree of subcooling of refrigerant reaches a predetermined target degree of subcooling of refrigerant. When the calculated degree of subcooling of refrigerant is smaller than the target degree of subcooling of refrigerant, the degree of opening of the indoor expansion valves is decreased, whereby the flow rate of refrigerant in the indoor heat exchangers is decreased. Thus, substantially the entire gas refrigerant that has flowed into the indoor heat exchangers is condensed into liquid refrigerant before reaching the refrigerant exit of the indoor heat exchangers. When the flow rate of the refrigerant is small, the distance of the remaining portion of the indoor heat exchanger in which the liquid refrigerant flows (the distance of the section between the site at which substantially the entire refrigerant has been condensed and the refrigerant exit in the indoor heat exchangers) is relatively increased. Thus, the liquid refrigerant is cooled as it flows in the long section, and the temperature of the refrigerant is greatly decreased. As a result, the refrigerant temperature at the refrigerant exit of the indoor heat exchangers is lowered, whereby the degree of subcooling of refrigerant is increased.

When the calculated degree of subcooling of refrigerant is small relative to the target degree of subcooling of refrigerant, the degree of opening of the indoor expansion valves is increased. Thus, the flow rate of the refrigerant in the indoor heat exchangers is increased. In this case, too, substantially the entire gas refrigerant that has flowed into the indoor heat exchangers is condensed into liquid refrigerant before reaching the refrigerant exit of the indoor heat exchangers. However, compared with the case where the flow rate of refrigerant is small, the distance of the remaining portion of the indoor heat exchanger in which the liquid refrigerant flows is short. Thus, even though the liquid refrigerant is cooled as it flows in the short section, the temperature decrease is small. Thus, the degree of subcooling of refrigerant at the refrigerant exit of the indoor heat exchangers is decreased.

When the air-conditioning apparatus is conducting the heating operation or the heating-main operation, the condensed liquid refrigerant may be stagnated in the indoor heat exchangers serving as condensers. When the liquid refrigerant is stagnated in the indoor heat exchangers serving as condensers, the distance between the refrigerant entry and the site at which the liquid refrigerant is stagnated in the indoor heat exchangers is decreased. Thus, the heating capacity is lowered compared with the case where the refrigerant is not stagnated in the indoor heat exchangers serving as condensers. In this case, it is preferable to cause the refrigerant stagnated in the indoor heat exchangers serving as condensers to flow out toward the outdoor unit by increasing the degree of opening of the outdoor expansion valves for the outdoor unit (hereafter referred to as "refrigerant stagnation elimination control"), for example.

In order to implement the refrigerant stagnation elimination control, it is determined whether refrigerant is stagnated in the indoor heat exchangers serving as condensers. This determination may be made by using the degree of subcooling of refrigerant at the refrigerant exit of the indoor heat exchangers. Namely, when the refrigerant is stagnated in the indoor heat exchangers, the refrigerant temperature at the refrigerant exit of the indoor heat exchangers is lowered, so that the degree of subcooling of refrigerant is increased. Thus, by determining whether the degree of subcooling of refrigerant is a value determined in advance experimentally or more, for example, it can be determined whether the refrigerant is stagnated in the indoor heat exchangers serving as condensers.

Specifically, when the degree of subcooling of refrigerant is the predetermined value or more, it is determined that the refrigerant is stagnated in the indoor heat exchangers serving as condensers, and the refrigerant stagnation elimination control is implemented. When the degree of subcooling of refrigerant becomes smaller than the predetermined value after the refrigerant stagnation elimination control, it is determined that the refrigerant stagnation has been eliminated or decreased, and the refrigerant stagnation elimination control is ended.

However, in practice, the heating capacity desired by the user may be ensured even when the refrigerant is stagnated in the indoor heat exchangers serving as condensers, depending on the refrigeration cycle conditions.

For example, there is the case in which the high pressure is increased because of a high rotation speed of the compressor, so that the temperature difference between the refrigerant temperature and the indoor temperature is large. In this case, even though the distance of the section in which there is no refrigerant stagnation (the distance between the refrigerant entry and the site at which the liquid refrigerant is stagnated) in the indoor heat exchangers serving as condensers is short, the exchange of heat can take place between the refrigerant and indoor air in the section without excess or deficiency. Thus, the indoor temperature could be increased to the temperature set by the user. In such a case, increasing the degree of opening of the outdoor expansion valves by implementing the refrigerant stagnation elimination control may lead to a decrease in the pressure of the refrigerant flowing in the liquid pipe (liquid pressure) or even in the high pressure. As a result, the temperature difference between the refrigerant temperature and the indoor temperature may be decreased such that the heating capacity can be lowered.

An object of the present disclosure is to provide an air-conditioning apparatus such that the heating capacity of an indoor unit performing a heating operation can be ensured by decreasing or eliminating the refrigerant stagnation in an indoor heat exchanger as needed.

An outdoor unit (the present outdoor unit) for the air-conditioning apparatus according to the present disclosure includes an outdoor heat exchanger; a compressor; a refrigerant pipe configured to couple the outdoor heat exchanger and the compressor with an indoor unit including an indoor heat exchanger; and a control unit that determines whether the heating capacity of the indoor unit performing a heating operation is lowered by the refrigerant stagnated in the indoor heat exchanger.

In the present outdoor unit, the control unit may be configured to perform refrigerant stagnation elimination control for causing refrigerant stagnated in the indoor heat exchanger of the indoor unit to flow out from the indoor heat exchanger when determining that the heating capacity of the indoor unit performing the heating operation is lowered by the refrigerant stagnated in the indoor heat exchanger.

The present outdoor unit may further include a flow rate adjustment unit that adjusts the flow rate of the refrigerant flowing in the refrigerant pipe. In this case, the control unit may increase the flow rate of refrigerant from the indoor heat exchanger by controlling the flow rate adjustment unit during the refrigerant stagnation elimination control. The flow rate adjustment unit may be an expansion valve. In this case, the control unit may increase the degree of opening of the expansion valve by a predetermined amount of change during the refrigerant stagnation elimination control.

The present outdoor unit may further include a high-pressure sensor that detects the pressure of the refrigerant that flows from the compressor to the indoor heat exchanger. In this case, the control unit may calculate a high-pressure saturation temperature on the basis of the pressure detected by the high-pressure sensor, and perform the refrigerant stagnation elimination control when a first temperature difference between the high-pressure saturation temperature and an indoor unit side refrigerant temperature, which is the temperature of the refrigerant discharged out of the indoor heat exchanger, is a predetermined value or more; when the high-pressure saturation temperature is a first predetermined temperature or more; and when the indoor unit side refrigerant temperature is a second predetermined temperature or less.

An air-conditioning apparatus according to the present disclosure (the present air-conditioning apparatus) includes the present outdoor unit and the indoor unit, and the indoor unit may include a refrigerant temperature sensor that detects the temperature of the refrigerant discharged out of the indoor heat exchanger. The present air-conditioning apparatus may further include a plurality of the indoor units. In this case, the control unit of the present outdoor unit may calculate an average indoor unit side refrigerant temperature which is an average value of the indoor unit side refrigerant temperatures in the indoor units, and recognize a temperature difference between the average indoor unit side refrigerant temperature and the high-pressure saturation temperature as the first temperature difference.

According to the present outdoor unit, when the refrigerant is stagnated in the indoor heat exchanger of the indoor unit performing the heating operation, it is determined whether the heating capacity of the indoor unit is lowered by the stagnation of the refrigerant in the indoor heat exchanger (whether the refrigerant stagnation affects the heating capacity of the indoor unit). Then, in the present outdoor unit, the refrigerant stagnation in the indoor heat exchanger can be eliminated as needed. In other words, when it is determined that the heating capacity is lowered, the refrigerant stagnation elimination control is implemented, whereby the refrigerant stagnation in the indoor heat exchanger of the indoor unit performing the heating operation is decreased or eliminated. Thus, the refrigerant stagnation in the indoor heat exchanger can be mitigated or eliminated as needed. As a result, the heating capacity in the indoor unit performing the heating operation can be ensured.

In the following, an embodiment (example) of the present disclosure will be described with reference to the attached drawings. In the air-conditioning apparatus according to the present example, five indoor units are coupled in parallel to two outdoor units. In the air-conditioning apparatus, the operation state of each indoor unit can be set (selected) for the cooling operation or the heating operation, and the indoor units can be simultaneously operated (the so-called "cooling/heating-free operation).

The present disclosure is not limited to the following embodiment (example). The present disclosure may be variously modified without departing from the scope of the disclosure.

As illustrated in FIG. 1, an air-conditioning apparatus 1 according to the present example is provided with two outdoor units 2*a* and 2*b*, five indoor units 8*a* to 8*e*, five switching units 6*a* to 6*e*, and branching units 70, 71, and 72. The outdoor units 2*a* and 2*b*, the indoor units 8*a* to 8*e*, the switching units 6*a* to 6*e*, and the branching units 70 to 72 are mutually coupled via a high-pressure gas pipe 30, high-pressure gas branch pipes 30*a* and 30*b*, a low-pressure gas pipe 31, low-pressure gas branch pipes 31*a* and 31*b*, a liquid pipe 32, and liquid branch pipes 32*a* and 32*b*. Thus, a refrigerant circuit for the air-conditioning apparatus 1 is produced.

The high-pressure gas pipe 30, the high-pressure gas branch pipes 30*a* and 30*b*, the low-pressure gas pipe 31, and the low-pressure gas branch pipes 31*a* and 31*b* constitute a gas pipe for the air-conditioning apparatus 1. The liquid pipe 32 and the liquid branch pipes 32*a* and 32*b* constitute a liquid pipe for the air-conditioning apparatus 1.

In the air-conditioning apparatus 1, various operations can be selected depending on the open/close state of various valves disposed at the outdoor units 2*a* and 2*b* and the switching units 6*a* to 6*e*. In the heating operation, all of the indoor units may perform the heating operation. In a heating-main operation, the total capacity required from the indoor units performing the heating operation is greater than the total capacity required from the indoor units performing the cooling operation. In the cooling operation, all of the indoor units may perform the cooling operation. In the cooling-main operation, the total capacity required from the indoor units performing the cooling operation is greater than the total capacity required from the indoor units performing the heating operation. In the following description, the heating operation among the above operations will be described by way of example with reference to FIG. 1.

FIG. 1 is a refrigerant circuit diagram in the case where all of the indoor units 8*a* to 8*e* are performing the heating operation. First, the outdoor units 2*a* and 2*b* will be described. The outdoor units 2*a* and 2*b* have identical configurations. Thus, in the following description, the configuration of the outdoor unit 2*a* will be described and the detailed description of the outdoor unit 2*b* will be omitted.

As illustrated in FIG. 1, the outdoor unit 2*a* is provided with a compressor 21*a*; a first three-way valve 22*a* and a second three-way valve 23*a* as flow passage switching units (switching members); a first outdoor heat exchanger 24*a*; a second outdoor heat exchanger 25*a*; an outdoor fan 26*a*; an accumulator 27*a*; an oil separator 28*a*; a receiver tank 29*a*; a first outdoor expansion valve 40*a* coupled to the first outdoor heat exchanger 24*a*; a second outdoor expansion valve 41*a* coupled to the second outdoor heat exchanger 25*a*; a hot gas bypass pipe 36*a*; a first electromagnetic valve 42*a* disposed at the hot gas bypass pipe 36*a*; an oil return pipe 37*a*; a second electromagnetic valve 43*a* disposed at the oil return pipe 37*a*; and closing valves 44*a* to 46*a*. The first outdoor expansion valve 40*a* and the second outdoor expansion valve 41*a* are flow rate adjustment units (switching members) according to the present disclosure.

The compressor 21*a* is driven by a motor (not shown) whose rotation speed is controlled by an inverter. Namely, the compressor 21*a* is a performance variable compressor with variable operation capacity. As illustrated in FIG. 1, the discharge side of the compressor 21*a* is coupled to the inflow side of the oil separator 28*a* via a refrigerant pipe. The outflow side of the oil separator 28*a* is coupled to the closing valve 44*a* via an outdoor unit high-pressure gas pipe 33*a*. The intake side of the compressor 21*a* is coupled to the outflow side of the accumulator 27*a* via a refrigerant pipe. The inflow side of the accumulator 27*a* is coupled to the closing valve 45*a* via an outdoor unit low-pressure gas pipe 34*a*.

The first three-way valve 22*a* and the second three-way valve 23*a* are valves configured to switch the direction of flow of refrigerant (flow passage switching means, or flow passage switching valves). Namely, the first three-way valve 22*a* and the second three-way valve 23*a* switch the coupling of one of refrigerant inlet/outlet openings of the corresponding outdoor heat exchangers 24*a* and 25*a* to the discharge side (refrigerant discharge opening) or the intake side (refrigerant intake opening) of the compressor 21*a*.

The first three-way valve 22*a* has three ports a, b, and c. The second three-way valve 23*a* has three ports d, e, and f. A refrigerant pipe coupled to the port a of the first three-way valve 22*a* is coupled to the outdoor unit high-pressure gas pipe 33*a* at a coupling point A. The port b and the first outdoor heat exchanger 24*a* are coupled via a refrigerant pipe. A refrigerant pipe coupled to the port c is coupled to the outdoor unit low-pressure gas pipe 34*a* at a coupling point D.

A refrigerant pipe coupled to the port d of the second three-way valve 23*a* is coupled at the coupling point A to the refrigerant pipe coupled to the outdoor unit high-pressure gas pipe 33*a* and the port a of the first three-way valve 22*a*. The port e and the second outdoor heat exchanger 25*a* are coupled via a refrigerant pipe. A refrigerant pipe coupled to the port f is coupled at a coupling point C to the refrigerant pipe coupled to the port c of the first three-way valve 22*a*.

The first outdoor heat exchanger 24*a* and the second outdoor heat exchanger 25*a* include a number of fins (not shown) made primarily of aluminum material and a plurality of copper pipes (not shown) in which refrigerant is circulated. As described above, one refrigerant inlet/outlet opening of the first outdoor heat exchanger 24*a* is coupled to the port b of the first three-way valve 22*a*. The other refrigerant inlet/outlet opening of the first outdoor heat exchanger 24*a* is coupled to one port of the first outdoor expansion valve 40*a* via a refrigerant pipe. The other port of the first outdoor expansion valve 40*a* is coupled to the closing valve 46*a* via an outdoor unit liquid pipe 35*a*.

One refrigerant inlet/outlet opening of the second outdoor heat exchanger 25*a* is coupled to the port e of the second three-way valve 23*a* via refrigerant pipe, as described above. The other refrigerant inlet/outlet opening of the second outdoor heat exchanger 25*a* is coupled to one port of the second outdoor expansion valve 41*a* via a refrigerant pipe. The other port of the second outdoor expansion valve 41*a* is coupled to the outdoor unit liquid pipe 35*a* at a coupling point B via a refrigerant pipe.

The first outdoor expansion valve 40*a* and the second outdoor expansion valve 41*a* are electric expansion valves driven by a pulse motor (not shown). The degree of opening of each of the outdoor expansion valves is adjusted by the number of pulses given to the pulse motor.

The outdoor fan 26*a* is disposed in the vicinity of the first outdoor heat exchanger 24*a* and the second outdoor heat exchanger 25*a*. The outdoor fan 26*a* is a propeller fan made of a resin material and is rotated by a fan motor (not shown). Open-air taken into the outdoor unit 2*a* by the outdoor fan 26*a* exchanges heat with the refrigerant in the first outdoor heat exchanger 24*a* and/or the second outdoor heat exchanger 25*a* and is then expelled outside the outdoor unit 2*a*. According to the present example, a performance upper-limit rotation speed of 900 rpm is set for the outdoor fan 26*a* (fan motor of the outdoor fan 26*a*).

The inflow side of the accumulator 27*a* is coupled to the outdoor unit low-pressure gas pipe 34*a*. The outflow side of the accumulator 27*a* is coupled to the intake side of the compressor 21*a* via a refrigerant pipe. The accumulator 27*a* separates the inflow refrigerant into gas refrigerant and liquid refrigerant. The separated gas refrigerant is suctioned into the compressor 21*a*.

The inflow side of the oil separator 28*a* is coupled to the discharge side of the compressor 21*a* via a refrigerant pipe. The outflow side of the oil separator 28*a* is coupled to the outdoor unit high-pressure gas pipe 33*a*. The oil separator 28*a* separates refrigerant oil for the compressor 21*a*, which is contained in the refrigerant discharged, from the compressor 21*a*. The separated refrigerant oil is suctioned into the compressor 21*a* via the oil return pipe 37*a* (as will be described later).

The receiver tank 29*a* is disposed between the coupling point B of the outdoor unit liquid pipe 35*a* and the closing valve 46*a*. The receiver tank 29*a* is a container that can contain the refrigerant. The receiver tank 29*a* adjusts the amount of refrigerant in the first outdoor heat exchanger 24*a* and the second outdoor heat exchanger 25*a*. Namely, the receiver tank 29*a* provides the role of a buffer. The receiver tank 29*a* has functions such as one for gas-liquid separation of the refrigerant.

Further, the receiver tank 29*a* has the function of removing moisture or foreign matter from refrigerant by using a filter (not shown) installed in the receiver tank 29*a*, for example.

One end of the hot gas bypass pipe 36*a* is coupled to the outdoor unit high-pressure gas pipe 33*a* at a coupling point E. The other end of the hot gas bypass pipe 36*a* is coupled to the outdoor unit low-pressure gas pipe 34*a* at a coupling point F. The hot gas bypass pipe 36*a* is provided with the first electromagnetic valve 42*a*. By opening or closing the first electromagnetic valve 42*a*, the state of the hot gas bypass pipe 36*a* can be switched between a refrigerant flow state and a non-refrigerant flow state.

One end of the oil return pipe 37*a* is coupled to an oil return opening of the oil separator 28*a*. The other end of the oil return pipe 37*a* is coupled at a coupling point G to a refrigerant pipe coupling the intake side of the compressor 21*a* and the outflow side of the accumulator 27*a*. The oil return pipe 37*a* is provided with the second electromagnetic valve 43*a*. By opening or closing the second electromagnetic valve 43*a*, the state of the oil return pipe 37*a* can be switched between the refrigerant flow state and the non-refrigerant flow state.

In addition, the outdoor unit 2*a* is provided with various sensors. As illustrated in FIG. 1, the refrigerant pipe coupling the discharge side of the compressor 21*a* and the oil separator 28*a* is provided with a high pressure sensor 50*a* and a discharge temperature sensor 53*a*. The high pressure sensor 50*a* (high pressure detection means, or a high-pressure detector) detects the pressure of the refrigerant discharged from the compressor 21*a*. The discharge temperature sensor 53*a* detects the temperature of the refrigerant discharged from the compressor 21*a*.

Between the coupling point F of the outdoor unit low-pressure gas pipe 34*a* and the inflow side of the accumulator 27*a*, a low pressure sensor 51*a* and an intake temperature sensor 54*a* are provided. The low pressure sensor 51*a* (low-pressure detection means, or a low-pressure detector) detects the pressure of the refrigerant suctioned into the compressor 21*a*. The intake temperature sensor 54*a* detects the temperature of the refrigerant suctioned into the compressor 21*a*.

Between the coupling point B of the outdoor unit liquid pipe 35*a* and the closing valve 46*a*, an intermediate pressure sensor 52*a* and a refrigerant temperature sensor 55*a* are provided. The intermediate pressure sensor 52*a* detects the pressure of the refrigerant flowing in the outdoor unit liquid pipe 35*a*. The refrigerant temperature sensor 55*a* detects the temperature of the refrigerant flowing in the outdoor unit liquid pipe 35*a*.

The refrigerant pipe configured to couple the port b of the first three-way valve 22*a* and the first outdoor heat exchanger 24*a* is provided with a first heat exchanger temperature sensor 56*a*. The first heat exchanger temperature sensor 56*a* detects the temperature of the refrigerant that flows out of the first outdoor heat exchanger 24*a* or that flows into the first outdoor heat exchanger 24*a*.

The refrigerant pipe configured to couple the port e of the second three-way valve 23*a* and the second outdoor heat exchanger 25*a* is provided with a second heat exchanger temperature sensor 57*a*. The second heat exchanger temperature sensor 57*a* detects the temperature of the refrigerant that flows out of the second outdoor heat exchanger 25*a* or that flows into the second outdoor heat exchanger 25*a*.

Further, an open-air temperature sensor 58*a* is provided in the vicinity of a suction opening (not shown) of the outdoor unit 2*a*. The open-air temperature sensor 58*a* detects the temperature of the open-air that flows into the outdoor unit 2*a*, i.e., the open-air temperature.

The outdoor unit 2*a* is provided with a control means (control unit) 100*a* mounted on a control substrate (not shown). The control means 100*a* includes a CPU 110*a*, a storage unit 120*a*, and a communication unit 130*a*. The CPU 110*a* receives detection signals from the sensors installed in the outdoor unit 2*a*. The CPU 110*a* also receives control signals outputted from the indoor units 8*a* to 8*e* via the communication unit 130*a*. The CPU 110*a* performs various controls on the basis of the detection signals and the control signals. For example, the CPU 110*a* performs drive control for the compressor 21*a*; switching control for the first three-way valve 22*a* and the second three-way valve 23*a*; rotation control for the fan motor of the outdoor fan 26*a*; and opening degree control for the first outdoor expansion valve 40*a* and the second outdoor expansion valve 41*a*.

The storage unit 120*a* includes a ROM and/or a RAM. The storage unit 120*a* may store a control program for the outdoor unit 2*a* and detection values corresponding to the detection signals from the sensors. The communication unit 130*a* provides an interface for enabling communications between the outdoor unit 2*a* and the indoor units 8*a* to 8*e*.

The configuration of the outdoor unit 2*b* is the same as the configuration of the outdoor unit 2*a*. Namely, the constituent elements (devices and members) of the outdoor unit 2*b* are designated by the signs designating the corresponding constituent elements of the outdoor unit 2*a* with the letter at the end of each sign changed from "a" to "b". However, the signs for the first three-way valve, the second three-way valve, and the coupling points of the refrigerant pipes are varied between the outdoor unit 2*a* and the outdoor unit 2*b*. Namely, the ports a, b, and c of the first three-way valve 22*a* of the outdoor unit 2*a* correspond to ports g, h, and j of the first three-way valve 22*b* of the outdoor unit 2*b*. The ports d, e, and f of the second three-way valve 23*a* of the outdoor unit 2*a* correspond to the ports k, m, and n of the second three-way valve 23*b* of the outdoor unit 2*b*. The coupling points A, B, C, D, E, F, and G of the outdoor unit 2*a* correspond to the coupling points H, J, K, M, N, P, and Q of the outdoor unit 2*b*.

As illustrated in FIG. 1, in the refrigerant circuit at the time of the heating operation, the three-way valves are switched so that the two outdoor heat exchangers installed in each of the outdoor units 2*a* and 2*b* serve as evaporators.

Specifically, the first three-way valve 22*a* of the outdoor unit 2*a* is switched to provide communication between the port b and the port c. The second three-way valve 23*a* of the outdoor unit 2*a* is switched to provide communication between the port e and the port f. The first three-way valve 22*b* of the outdoor unit 2*b* is switched to provide communication between the port h and the port j. The second three-way valve 23*b* of the outdoor unit 2*b* is switched to provide communication between the port m and the port n. In FIG. 1, the ports of the three-way valves that are in communication are indicated by solid lines. The ports that are not in communication are indicated by broken lines.

Each of the five indoor units 8*a* to 8*e* is provided with an indoor exchanger, an indoor expansion valve (a flow rate adjustment unit for the indoor unit), and an indoor fan. Specifically, the indoor heat exchangers 81*a* to 81*e*, the indoor expansion valves 82*a* to 82*e*, and the indoor fans 83*a* to 83*e* are provided. The respective indoor units 8*a* to 8*e* have identical configurations. Thus, in the following description, only the configuration of the indoor unit 8*a* will be described, and the description of the other indoor units 8*b* to 8*e* will be omitted.

One of the refrigerant inlet/outlet openings of the indoor heat exchanger 81*a* is coupled to one port of the indoor expansion valve 82*a* via a refrigerant pipe. The other refrigerant inlet/outlet opening of the indoor heat exchanger 81*a* is coupled to the switching unit 6*a* (as will be described later) via a refrigerant pipe. When the indoor unit 8*a* performs the cooling operation, the indoor heat exchanger 81*a* serves as an evaporator. When the indoor unit 8*a* performs the heating operation, the indoor heat exchanger 81*a* serves as a condenser.

One port of the indoor expansion valve 82*a* is coupled to the indoor heat exchanger 81*a*, as described above. The other port of the indoor expansion valve 82*a* is coupled to the liquid pipe 32. When the indoor heat exchanger 81*a* serves as an evaporator, the degree of opening of the indoor expansion valve 82*a* is adjusted in accordance with the cooling capacity required from the indoor unit 8*a*. When the indoor heat exchanger 81*a* serves as a condenser, the degree of opening of the indoor expansion valve 82*a* is adjusted in accordance with the heating capacity required from the indoor unit 8*a*.

The indoor fan 83*a* is rotated by a fan motor (not shown). The indoor air taken into the indoor unit 8*a* by the indoor fan 83*a* exchanges heat with refrigerant in the indoor heat exchanger 81*a* and is then supplied indoor.

In addition to the configuration described above, the indoor unit 8*a* is provided with various sensors. Namely, the indoor unit 8*a* is provided with refrigerant temperature sensors 84*a* and 85*a*, and a room temperature sensor 86*a*. The refrigerant temperature sensor 84*a* (indoor unit side refrigerant temperature detection unit or indoor unit side refrigerant temperature detector) is disposed at the refrigerant pipe to the indoor heat exchanger 81*a* on the side closer to the indoor expansion valve 82*a* for detecting the temperature of refrigerant. The refrigerant temperature sensor 85*a* is disposed at the refrigerant pipe to the indoor heat exchanger 81*a* on the side closer to the switching unit 6*a* for detecting the temperature of refrigerant. The room temperature sensor 86*a* is installed in the vicinity of an indoor air suction opening (not shown) of the indoor unit 8*a* for detecting the temperature of the indoor air that flows into the indoor unit 8*a*, i.e., the indoor temperature.

The configuration of the indoor units 8*b* to 8*e* is the same as the configuration of the indoor unit 8*a*. Namely, the constituent elements (devices and members) of the indoor units 8*b* to 8*e* are designated by the corresponding signs designating the constituent elements of the indoor unit 8*a* with the letter "a" replaced with "b", "c", "d", or "e".

The air-conditioning apparatus 1 is provided with the five switching units 6*a* to 6*e* corresponding to the five indoor units 8*a* to 8*e*. Each of the switching units 6*a* to 6*e* is provided with two electromagnetic valves, a first diversion pipe, and a second diversion pipe. Specifically, the electromagnetic valves 61*a* to 61*e*, the electromagnetic valves 62*a* to 62*e*, the first diversion pipes 63*a* to 63*e*, and the second diversion pipes 64*a* to 64*e* are provided. The switching units 6*a* to 6*e* have identical configurations. Thus, in the following description, only the configuration of the switching unit 6*a* will be described and the description of the other switching units 6*b* to 6*e* will be omitted.

One end of the first diversion pipe 63*a* is coupled to the high-pressure gas pipe 30. One end of the second diversion pipe 64*a* is coupled to the low-pressure gas pipe 31. The other end of the first diversion pipe 63*a* and the other end of the second diversion pipe 64*a* are mutually coupled at a coupling point. The coupling point is coupled to the indoor heat exchanger 81*a* via a refrigerant pipe. The first diversion pipe 63*a* is provided with the electromagnetic valve 61*a*. The second diversion pipe 64*a* is provided with the electromagnetic valve 62*a*. By opening or closing the electromagnetic valve 61*a* and the electromagnetic valve 62*a*, the refrigerant flow passage in the refrigerant circuit can be switched. Namely, by opening or closing the electromagnetic valve 61*a* and the electromagnetic valve 62*a*, the coupling of the indoor heat exchanger 81*a* of the indoor unit 8*a* corresponding to the switching unit 6*a* to the compressor 21*a* and/or the compressor 21*b* can be switched. Specifically, depending on the opening or closing of the electromagnetic valve 61*a* and the electromagnetic valve 62*a*, the indoor heat exchanger 81*a* is coupled to the discharge side (high-pressure gas pipe 30 side) of the compressor 21*a* and/or the compressor 21*b*, or the indoor heat exchanger 81*a* is coupled to the intake side (low-pressure gas pipe 31 side) of the compressor 21*a* and/or the compressor 21*b*.

As mentioned above, the switching units 6*b* to 6*e* have the same configuration as the configuration of the switching unit 6*a*. Namely, the constituent elements (devices and members) of the switching units 6*b* to 6*e* are designated by the signs designating the corresponding constituent elements of the switching unit 6*a* with the last letter "a" replaced with "b", "c", "d", or "e".

With reference to FIG. 1, the coupling of the outdoor units 2*a* and 2*b*, the indoor units 8*a* to 8*e* and the switching units 6*a* to 6*e* with the high-pressure gas pipe 30, the high-pressure gas branch pipes 30*a* and 30*b*, the low-pressure gas pipe 31, the low-pressure gas branch pipes 31*a* and 31*b*, the liquid pipe 32, the liquid branch pipes 32*a* and 32*b*, and the branching units 70 to 72 will be described.

To the closing valve 44*a* of the outdoor unit 2*a*, one end of the high-pressure gas branch pipe 30*a* is coupled. To the closing valve 44*b* of the outdoor unit 2*b*, one end of the high-pressure gas branch pipe 30*b* is coupled. The other end of the high-pressure gas branch pipe 30*a* and the other end of the high-pressure gas branch pipe 30*b* are coupled to the branching unit 70. To the branching unit 70, one end of the high-pressure gas pipe 30 is coupled. The other end of the high-pressure gas pipe 30 is branched and coupled to the first diversion pipes 63*a* to 63*e* of the switching units 6*a* to 6*e*.

To the closing valve 45*a* of the outdoor unit 2*a*, one end of the low-pressure gas branch pipe 31*a* is coupled. To the closing valve 45*b* of the outdoor unit 2*b*, one end of the low-pressure gas branch pipe 31*b* is coupled. The other end of the low-pressure gas branch pipe 31*a* and the other end of the low-pressure gas branch pipe 31*b* are coupled to the branching unit 71. To the branching unit 71, one end of the low-pressure gas pipe 31 is coupled. The other end of the low-pressure gas pipe 31 is branched and coupled to the second diversion pipes 64*a* to 64*e* of the switching units 6*a* to 6*e*.

To the closing valve 46*a* of the outdoor unit 2*a*, one end of the liquid branch pipe 32*a* is coupled. To the closing valve 46*b* of the outdoor unit 2*b*, one end of the liquid branch pipe 32*b* is coupled. The other end of the liquid branch pipe 32*a* and the other end of the liquid branch pipe 32*b* are coupled to the branching unit 72. To the branching unit 72, one end of the liquid pipe 32 is coupled. The other end of the liquid pipe 32 is branched and coupled to the refrigerant pipes to the indoor expansion valves 82*a* to 82*e* of the indoor units 8*a* to 8*e*.

The indoor heat exchangers 81*a* to 81*e* of the indoor units 8*a* to 8*e* are coupled to the coupling points between the first diversion pipes 63*a* to 63*e* and the second diversion pipes 64*a* to 64*e* of the corresponding switching units 6*a* to 6*e* via refrigerant pipes.

Via the above-described couplings, a refrigerant circuit of the air-conditioning apparatus 1 is configured. By causing refrigerant to flow in the refrigerant circuit, a refrigeration cycle can be implemented.

An operation of the air-conditioning apparatus 1 according to the present example will be described with reference to FIG. 1. In FIG. 1, the heat exchangers in the outdoor units 2*a* and 2*b* and the indoor units 8*a* to 8*e* that are used as condensers are indicated by hatching. The heat exchangers used as evaporators are indicated without hatching. With regard to the open/close state of the first electromagnetic valve 42*a* and the second electromagnetic valve 43*a* of the outdoor unit 2*a*, the first electromagnetic valve 42*b* and the second electromagnetic valve 43*b* of the outdoor unit 2*b*, and the electromagnetic valves 61*a* to 61*e* and the electromagnetic valves 62*a* to 62*e* of the switching units 6*a* to 6*e*, the valves being closed are indicated by solid areas, while the valves being opened are indicated by blanks.

The arrows in the drawing indicate the flow of the refrigerant.

In the example illustrated in FIG. 1, all of the indoor units 8*a* to 8*e* are performing the heating operation. When the heating capacity (operation capacity) required from the indoor units 8*a* to 8*e* is high, both of the outdoor units 2*a* and 2*b* are operated.

In this case, the first three-way valve 22*a* of the outdoor unit 2*a* is switched to provide communication between the port b and the port c. Thus, the first outdoor heat exchanger 24*a* serves as an evaporator. The second three-way valve 23*a* of the outdoor unit 2*a* is switched to provide communication between the port e and the port f. Thus, the second outdoor heat exchanger 25*a* serves as an evaporator. The first three-way valve 22*b* of the outdoor unit 2*b* is switched to provide communication between the port h and the port j. Thus, the first outdoor heat exchanger 24*b* serves as an evaporator. The second three-way valve 23*b* of the outdoor unit 2*b* is switched to provide communication between the port m and the port n. Thus, the second outdoor heat exchanger 25*b* serves as an evaporator.

The first electromagnetic valve 42*a* and the second electromagnetic valve 43*a* of the outdoor unit 2*a* are both closed. Similarly, the first electromagnetic valve 42*b* and the second electromagnetic valve 43*b* of the outdoor unit 2*b* are both closed. Thus, the hot gas bypass pipes 36*a* and 36*b* and the oil return pipes 37*a* and 37*b* do not permit the flow of refrigerant or refrigerating machine oil.

By opening the electromagnetic valves 61*a* to 61*e* of the switching units 6*a* to 6*e* for the corresponding indoor units 8*a* to 8*e*, the refrigerant flows in the first diversion pipes 63*a* to 63*e*. By closing the electromagnetic valves 62*a* to 62*e*, the flow of refrigerant in the second diversion pipes 64*a* to 64*e* is stopped. Thus, all of the indoor heat exchangers 81*a* to 81*e* of the indoor units 8*a* to 8*e* serve as condensers.

The high-pressure refrigerant discharged from the compressor 21*a* flows in the outdoor unit high-pressure gas pipe 33*a* via the oil separator 28*a*. The high-pressure refrigerant flows into the high-pressure gas branch pipe 30*a* via the closing valve 44*a*. The high-pressure refrigerant discharged from the compressor 21*b* flows in the outdoor unit high-pressure gas pipe 33*b* via the oil separator 28*b*. The high-pressure refrigerant flows into the high-pressure gas branch pipe 30*b* via the closing valve 44*b*. The flows of high-pressure refrigerant in the high-pressure gas branch pipes 30*a* and 30*b* are converged in the branching unit 70 and enter the high-pressure gas pipe 30. The high-pressure refrigerant is diverged from the high-pressure gas pipe 30 into the respective switching units 6*a* to 6*e*.

The high-pressure refrigerant that has flowed into the switching units 6*a* to 6*e* flows through the corresponding first diversion pipes 63*a* to 63*e* provided with the electromagnetic valves 61*a* to 61*e* that are opened, and then flows out of the switching units 6*a* to 6*e*. The high-pressure refrigerant then flows into the indoor units 8*a* to 8*e* corresponding to the switching units 6*a* to 6*e*.

The high-pressure refrigerant that has flowed into the indoor units 8*a* to 8*e* flows into the corresponding indoor heat exchangers 81*a* to 81*e*, exchanges heat with the indoor air, and is thereby condensed. Thus, the indoor air is heated, and the indoor spaces in which the indoor units 8*a* to 8*e* are installed are heated. The high-pressure refrigerant that has flowed out of the indoor heat exchangers 81*a* to 81*e* is passed through the corresponding indoor expansion valves 82*a* to 82*e* and decompressed. The degree of opening of the indoor expansion valves 82*a* to 82*e* is determined in accordance with the subcooling degree of the refrigerant at the refrigerant exit of the corresponding indoor heat exchangers 81*a* to 81*e*. The subcooling degree of refrigerant is determined by, for example, subtracting the refrigerant temperature at the refrigerant exit of the indoor heat exchangers 81*a* to 81*e* that is detected by the refrigerant temperature sensors 84*a* to 84*e* (indoor unit side refrigerant temperatures Tif as will be described later) from the high-pressure saturation temperature (which corresponds to the condensation temperature in the indoor heat exchangers 81*a* to 81*e*) calculated from the pressure detected by the high-pressure sensor 50*a* of the outdoor unit 2*a* and the high-pressure sensor 50*b* of the outdoor unit 2*b*.

The flows of intermediate-pressure refrigerant out of the indoor units 8*a* to 8*e* enter the liquid pipe 32 and converged, and the converged refrigerant flows into the branching unit 72. The intermediate-pressure refrigerant that has been diverged from the branching unit 72 into the liquid branch pipe 32*a* flows into the outdoor unit 2*a* via the closing valve 46*a*. The intermediate-pressure refrigerant that has flowed into the outdoor unit 2*a* flows in the outdoor unit liquid pipe 35*a* and is diverged at the coupling point B. The diverged flows of intermediate-pressure refrigerant pass through the first outdoor expansion valve 40*a* and the second outdoor expansion valve 41*a* and are decompressed to produce low-pressure refrigerant. Similarly, the intermediate-pressure refrigerant that has been diverged from the branching unit 72 into the liquid branch pipe 32*b* flows via the closing valve 46*b* into the outdoor unit 2*b*. The intermediate-pressure refrigerant that has flowed into the outdoor unit 2*b* flows in the outdoor unit liquid pipe 35*b* and is diverged at a coupling point J. The diverged flows of intermediate-pressure refrigerant pass through the first outdoor expansion valve 40*b* and the second outdoor expansion valve 41*b* and are decompressed to produce low-pressure refrigerant.

The degree of opening of the first outdoor expansion valve 40*a* is determined by the degree of superheat of the refrigerant at the refrigerant exit of the first outdoor heat exchanger 24*a*. The degree of superheat of refrigerant is determined by, for example, subtracting the low-pressure saturation temperature calculated from the pressure detected by the low pressure sensor 51*a* of the outdoor unit 2*a* (corresponding to the evaporation temperature in the first outdoor heat exchanger 24*a*) from the refrigerant temperature at the refrigerant exit of the first outdoor heat exchanger 24*a* that is detected by the first heat exchanger temperature sensor 56*a*.

The degree of opening of the first outdoor expansion valve 40*b* is determined in accordance with the degree of superheat of refrigerant at the refrigerant exit of the first outdoor heat exchanger 24*b*. The degree of superheat of refrigerant is determined by, for example, subtracting the low-pressure saturation temperature calculated from the pressure detected by the low pressure sensor 51*b* of the outdoor unit 2*b* (corresponding to the evaporation temperature in the first outdoor heat exchanger 24*b*) from the refrigerant temperature at the refrigerant exit of the first outdoor heat exchanger 24*b* that is detected by the first heat exchanger temperature sensor 56*b*.

The degree of opening of the second outdoor expansion valve 41*a* is determined in accordance with the degree of superheat of refrigerant at the refrigerant exit of the second outdoor heat exchanger 25*a*. The degree of superheat of refrigerant is determined by, for example, subtracting the low-pressure saturation temperature calculated from the pressure detected by the low pressure sensor 51*a* of the outdoor unit 2*a* (corresponding to the evaporation temperature in the second outdoor heat exchanger 25*a*) from the refrigerant temperature at the refrigerant exit of the second outdoor heat exchanger 25*a* that is detected by the second heat exchanger temperature sensor 57*a*.

The degree of opening of the second outdoor expansion valve 41*b* is determined in accordance with the degree of superheat of refrigerant at the refrigerant exit of the second outdoor heat exchanger 25*b*. The degree of superheat of refrigerant is determined by, for example, subtracting the low-pressure saturation temperature calculated from the pressure detected by the low pressure sensor 51*b* of the outdoor unit 2*b* (corresponding to the evaporation temperature in the second outdoor heat exchanger 25*b*) from the refrigerant temperature at the refrigerant exit of the second outdoor heat exchanger 25*b* that is detected by the second heat exchanger temperature sensor 57*b*.

The CPU 110*a* of the control means 100*a* determines the degree of superheat of refrigerant at the refrigerant exit of the first outdoor heat exchanger 24*a* and the degree of superheat of refrigerant at the refrigerant exit of the second outdoor heat exchanger 25*a* at a predetermined timing (such as at 30 seconds intervals). The CPU 110*a* controls the degree of opening of the first outdoor expansion valve 40*a* and the second outdoor expansion valve 41*a* in accordance with the above values.

Similarly, the CPU 110*b* of the control means 100*b* determines the degree of superheat of refrigerant at the refrigerant exit of the first outdoor heat exchanger 24*b* and the degree of superheat of refrigerant at the refrigerant exit of the second outdoor heat exchanger 25*b* at a predetermined timing (such as at 30 seconds intervals). The CPU 110*b* controls the degree of opening of the first outdoor expansion valve 40*b* and the second outdoor expansion valve 41*b* in accordance with the above values.

The low-pressure refrigerant that has been decompressed in the first outdoor expansion valve 40*a* flows into the first outdoor heat exchanger 24*a*, exchanges heat with open-air, and is evaporated. The low-pressure refrigerant that has flowed out of the first outdoor heat exchanger 24*a* converges at the coupling point C via the first three-way valve 22*a*.

Similarly, the low-pressure refrigerant that has been decompressed in the second outdoor expansion valve 41*a* flows into the second outdoor heat exchanger 25*a*, exchanges heat with open-air, and is evaporated. The low-pressure refrigerant that has flowed out of the second outdoor heat exchanger 25*a* converges at the coupling point C via the second three-way valve 23*a*. The flows of low-pressure refrigerant that have been converged at the coupling point C enter the outdoor unit low-pressure gas pipe 34*a* at the coupling point D. The low-pressure refrigerant that has flowed into the outdoor unit low-pressure gas pipe 34*a* is suctioned by the compressor 21*a* via the coupling point F and the accumulator 27*a* and then compressed again.

The low-pressure refrigerant that has been decompressed in the first outdoor expansion valve 40*b* flows into the first outdoor heat exchanger 24*b*, exchanges heat with open-air, and is evaporated. The low-pressure refrigerant that has flowed out of the first outdoor heat exchanger 24*b* converges at the coupling point K via the first three-way valve 22*b*.

Similarly, the low-pressure refrigerant that has been decompressed in the second outdoor expansion valve 41*b* flows into the second outdoor heat exchanger 25*b*, exchanges heat with open-air, and is evaporated. The low-pressure refrigerant that has flowed out of the second outdoor heat exchanger 25*b* converges at the coupling point K via the second three-way valve 23*b*. The flows of low-pressure refrigerant that have been converged at the coupling point K enter the outdoor unit low-pressure gas pipe 34*b* at the coupling point M. The low-pressure refrigerant that has flowed into the outdoor unit low-pressure gas pipe 34*b* is suctioned by the compressor 21*b* via the coupling point P and the accumulator 27*b* and compressed again.

Next, the operation, function, and effect of the refrigerant circuit of the air-conditioning apparatus 1 will be described with reference to FIGS. 1 and 2. First, the reason that the refrigerant stagnation in the indoor heat exchangers 81*a* to 81*e* can be detected on the basis of the degree of subcooling of refrigerant in the indoor heat exchangers 81*a* to 81*e* serving as condensers will be described. Then, a method of determining whether, when the refrigerant is stagnated in the indoor heat exchangers 81*a* to 81*e*, the heating capacity is decreased due to the refrigerant stagnation will be described. Further, refrigerant stagnation elimination control which is implemented to eliminate the refrigerant stagnation in the indoor heat exchangers 81*a* to 81*e* when it is determined that the heating capacity is decreased will be described.

That the refrigerant is stagnated in the indoor heat exchangers 81*a* to 81*e* means that the refrigerant is stagnated in at least one of the indoor heat exchangers 81*a* to 81*e*.

In the following description, the outdoor unit 2*a* of the outdoor units 2*a* and 2*b* is considered a master unit, and the CPU 110*a* of the control means 100*a* for the outdoor unit 2*a* as the master unit implements the refrigerant stagnation elimination control.

FIG. 1 depicts the refrigerant circuit of the air-conditioning apparatus 1 performing the heating operation. In the heating operation, as described above, the degree of opening of the individual indoor expansion valves 82*a* to 82*e* is determined in accordance with the degree of subcooling of refrigerant at the refrigerant exit of the corresponding indoor heat exchangers 81*a* to 81*e*. For example, the degree of opening of the indoor expansion valve 82*a* is determined in accordance with the degree of subcooling of refrigerant at the refrigerant exit of the corresponding indoor heat exchanger 81*a*. The degree of subcooling of refrigerant is determined as follows. A control means (not shown) for the indoor units 8*a* to 8*e* obtains the pressure detected by the high-pressure sensor 50*a* of the outdoor unit 2*a* and/or the high-pressure sensor 50*b* of the outdoor unit 2*b*, and calculates the high-pressure saturation temperature on the basis of the pressure. From the high-pressure saturation temperature, the refrigerant temperature detected by the refrigerant temperature sensors 84*a* to 84*e* (the refrigerant temperature at the refrigerant exit when the indoor heat exchangers 81*a* to 81*e* are serving as condensers) is subtracted, whereby the degree of subcooling of refrigerant is determined.

Meanwhile, in the indoor heat exchangers 81*a* to 81*e* serving as condensers, the refrigerant that has flowed in through the high-pressure gas pipe 30 and via the switching units (branching units) 6*a* to 6*e* exchanges heat with indoor air and is condensed. At this time, the condensed liquid refrigerant may be stagnated in the indoor heat exchangers 81*a* to 81*e*. When the liquid refrigerant is stagnated in the indoor heat exchangers 81*a* to 81*e*, the distance of the section between the refrigerant entry and the site of the liquid refrigerant stagnation in the indoor heat exchangers 81*a* to 81*e* is decreased. Thus, the refrigerant temperature at the refrigerant exit of the indoor heat exchangers 81*a* to 81*e* (the refrigerant temperature detected by the refrigerant temperature sensors 84*a* to 84*e*) is decreased, so that the degree of subcooling of refrigerant is increased.

As described above, the stagnation of refrigerant in the indoor heat exchangers 81*a* to 81*e* may cause the degree of subcooling of refrigerant to become greater than a predetermined target subcooling degree. In this case, the control means for the indoor units 8*a* to 8*e* increases the degree of opening of the indoor expansion valves 82*a* to 82*e* so as to increase the flow rate of the refrigerant in the indoor heat exchangers 81*a* to 81*e*. In this case, substantially the entire gas refrigerant that has flowed into the indoor heat exchangers 81*a* to 81*e* is condensed into liquid refrigerant before reaching the refrigerant exit of the indoor heat exchangers 81*a* to 81*e*. However, in this case, compared with the case where the flow rate of refrigerant is small, the distance of the remaining portion of the indoor heat exchangers 81*a* to 81*e* in which the liquid refrigerant flows (the distance of the section between the site at which substantially the entire refrigerant is condensed and the refrigerant exit in the indoor heat exchangers 81*a* to 81*e*) is decreased. Thus, the decrease in the temperature of the liquid refrigerant even when the liquid refrigerant is cooled as it flows in the section is small. Thus, the degree of subcooling of refrigerant at the refrigerant exit of the indoor heat exchangers 81*a* to 81*e* is decreased. Further, by increasing the degree of opening of the indoor expansion valves 82*a* to 82*e*, the refrigerant stagnated in the indoor heat exchangers 81*a* to 81*e* flows into the liquid pipe 32. Thus, the refrigerant stagnation in the indoor heat exchangers 81*a* to 81*e* is decreased or eliminated.

However, the refrigerant stagnation in the indoor heat exchangers 81*a* to 81*e* may not be much decreased even when the degree of opening of indoor expansion valves 82*a* to 82*e* is increased. For example, the degree of opening of the first outdoor expansion valves 40*a* and 40*b*, or the degree of opening of the second outdoor expansion valves 41*a* and 41*b* can be small. The degree of opening of the outdoor expansion valves 40*a* and 40*b* is controlled in accordance with the degree of superheat of the refrigerant at the refrigerant exit of the first outdoor heat exchangers 24*a* and 24*b* serving as evaporators. The degree of opening of the outdoor expansion valves 41*a* and 41*b* is controlled in accordance with the degree of superheat of the refrigerant at the refrigerant exit of the second outdoor heat exchangers 25*a* and 25*b* serving as evaporators. When the degrees of opening are small, the amount of refrigerant that flows from the liquid pipe 32 into the outdoor unit 2*a* and/or 2*b* is decreased. As a result, even when the degree of opening of the indoor expansion valves 82*a* to 82*e* is maximized, the refrigerant stagnation in the indoor heat exchangers 81*a* to 81*e* may not be sufficiently decreased. In this case, one of the two cases may be considered, depending on the state of the refrigeration cycle.

The first is the case in which the heating capacity in the indoor units 8*a* to 8*e* is ensured even when the refrigerant is stagnated in the indoor heat exchangers 81*a* to 81*e*. For example, when the rotation speed of the compressor 21*a* and/or 21*b* is high, the high pressure is increased and therefore the high-pressure saturation temperature (Tshp) is increased. In this case, the temperature difference between the temperature of the refrigerant that flows into the indoor heat exchangers 81*a* to 81*e* and the indoor air temperature is increased. Thus, even when the distance of the section between the refrigerant entry and the site of liquid refrigerant stagnation in the indoor heat exchangers 81*a* to 81*e* is short, the indoor temperature desired by the user can be maintained by the exchange of heat between the refrigerant and the indoor air.

The second is the case in which the heating capacity in the indoor units 8*a* to 8*e* is lacking due to the stagnation of the refrigerant in the indoor heat exchangers 81*a* to 81*e*. For example, when the high pressure is increased as described above, the temperature difference between the temperature of the refrigerant that flows into the indoor heat exchangers 81*a* to 81*e* and the indoor air temperature is increased. Nevertheless, the heating capacity in the indoor units 8*a* to 8*e* may be lacking. For example, when the amount of refrigerant stagnation in the indoor heat exchangers 81*a* to 81*e* is large or when the distance of the section between the refrigerant entry and the site of liquid refrigerant stagnation in the indoor heat exchangers 81*a* to 81*e* is very short, the indoor heat exchangers 81*a* to 81*e* are filled with liquid refrigerant or substantially filled with liquid refrigerant. In such a state, even when there is a temperature difference between the refrigerant temperature and the indoor temperature, the amount of exchange of heat in the indoor heat exchangers 81*a* to 81*e* may be lacking. As a result, the indoor temperature may fail to reach the temperature desired by the user.

In the latter case (where the heating capacity is lacking due to the refrigerant stagnation in the indoor heat exchangers 81*a* to 81*e*), the lack of heating capacity may be mitigated or eliminated as follows. For example, the degree of opening of the first outdoor expansion valves 40*a* and 40*b*, or the degree of opening of the second outdoor expansion valves 41*a* and 41*b* is increased (which corresponds to refrigerant stagnation elimination control as will be described later). In this way, the refrigerant stagnated in the indoor heat exchangers 81*a* to 81*e* can be caused to flow out into the outdoor unit 2*a* and/or 2*b* via the liquid pipe 32, whereby the lack of heating capacity can be eliminated.

In the former case (where, although there is refrigerant stagnation in the indoor heat exchangers 81*a* to 81*e*, heating capacity is ensured), the degree of opening of the first outdoor expansion valves 40*a* and 40*b*, or the degree of opening of the second outdoor expansion valves 41*a* and 41*b* may be increased so as to decrease or eliminate the refrigerant stagnation in the indoor heat exchangers 81*a* to 81*e*. However, in this case, the pressure of the refrigerant that flows in the liquid pipe 32 (liquid pressure) is decreased, which leads to a decrease in the high pressure. As a result, the temperature difference between the refrigerant temperature and the indoor temperature may be decreased and the heating capacity may be lowered.

Thus, according to the present embodiment, when the air-conditioning apparatus 1 performs the heating operation, and when the CPU 110*a* recognizes that, on the basis of the calculated degree of subcooling of refrigerant, refrigerant stagnation is present in the indoor heat exchangers 81*a* to 81*e* (i.e., when a refrigerant stagnation occurrence condition is satisfied), the CPU 110*a* determines whether to perform refrigerant stagnation elimination control. Specifically, the CPU 110*a*, on the basis of the calculated high-pressure saturation temperature Tshp and the indoor unit side refrigerant temperatures Tif obtained from the indoor units 8*a* to 8*e*, determines whether the heating capacity is ensured in the indoor units 8*a* to 8*e* or not (whether a refrigerant stagnation elimination control start condition is satisfied or not). When it is determined that the heating capacity is not ensured, the CPU 110*a* implements the refrigerant stagnation elimination control.

Specifically, the CPU 110*a*, on the basis of the high pressure obtained from the high-pressure sensor 50*a*, calculates the high-pressure saturation temperature Tshp. The CPU 110*a* also obtains the indoor unit side refrigerant temperatures Tif detected by the refrigerant temperature sensors 84*a* to 84*e* of the indoor units 8*a* to 8*e* and calculates an average of the temperatures, i.e., an average indoor unit side refrigerant temperature Tifa. The CPU 110*a* then recognizes the difference (Tshp−Tifa) as a first temperature difference indicating the degree of subcooling of refrigerant SCs of the air-conditioning apparatus 1. The CPU 110*a* then determines whether the first temperature difference is a predetermined value (such as 13° C.) or more. In this way, the CPU 110*a* determines whether the refrigerant stagnation occurrence condition is satisfied or not.

Whether the refrigerant stagnation occurrence condition is satisfied or not is determined by the CPU 110*a* on the basis of the degree of subcooling of refrigerant SCs of the air-conditioning apparatus 1 based on the average indoor unit side refrigerant temperature Tifa, rather than the degree of subcooling of refrigerant in the individual indoor units 8*a* to 8*e*. If the degree of subcooling of refrigerant in the individual indoor units 8*a* to 8*e* is used for determining whether the refrigerant stagnation occurrence condition is satisfied or not, the following inconvenience may be encountered.

For example, suppose that the degree of subcooling of refrigerant in the indoor unit 8*a* is greater than the degree of subcooling of refrigerant in the other indoor units 8*b* to 8*e*. In this case, it cannot be determined whether this is due to the magnitude of the operation capacity required from the indoor unit 8*a*, or the refrigerant is unevenly distributed on the indoor unit side of the refrigerant circuit. If the refrigerant stagnation elimination control is implemented when the degree of subcooling of refrigerant is large only in the indoor unit 8*a* because of the magnitude of the operation capacity required from the indoor unit 8*a*, the operation of the other indoor units (such as the indoor units 8*b* to 8*e*) may be adversely affected.

Thus, the CPU 110*a* determines whether the refrigerant stagnation occurrence condition is satisfied or not on the basis of the degree of subcooling of refrigerant SCs of the air-conditioning apparatus 1 which is based on the average indoor unit side refrigerant temperature Tifa. Thus, the CPU 110*a* can more reliably recognize that the degree of subcooling of refrigerant in the indoor unit 8*a* is greater than in the other indoor units 8*b* to 8*e* due to the uneven distribution of the refrigerant on the indoor unit side. As a result, the CPU 110*a* can recognize the presence or absence of refrigerant stagnation in each of the indoor units.

Upon determining that the refrigerant stagnation occurrence condition is satisfied, the CPU 110*a* determines whether the calculated high-pressure saturation temperature Thsp is the first predetermined temperature (such as a target high-pressure saturation temperature) or more, and whether any of the indoor unit side refrigerant temperatures Tif that have been obtained is a second predetermined temperature (such as 35° C.) or less. When the high-pressure saturation temperature Thsp is the first predetermined temperature or more and any of the indoor unit side refrigerant temperatures Tif is the second predetermined temperature or less, the CPU 110*a* determines that the refrigerant stagnation elimination control start condition is satisfied. Namely, the CPU 110*a* determines that the heating capacity in the indoor units 8*a* to 8*e* is lacking because liquid refrigerant is stagnated in (one or more of) the indoor heat exchangers 81*a* to 81*e*.

The first predetermined temperature and the second predetermined temperature are determined in advance experimentally, for example, and stored in the storage unit 120*a* of the control means 100*a*. The CPU 110*a* determines whether the high-pressure saturation temperature Thsp is the first predetermined temperature or more. In this way, the CPU 110*a* can see whether the temperature difference between the temperature of the refrigerant that flows into the indoor heat exchangers 81*a* to 81*e* and the indoor temperature obtained from the room temperature sensors 86*a* to 86*e* is such that the heating capacity required from the indoor units 8*a* to 8*e* can be provided. The CPU 110*a* also determines whether any of the indoor unit side refrigerant temperatures Tif that have been obtained is the second predetermined temperature or less. In this way, the CPU 110*a* can determine whether the exchange of heat between the refrigerant and indoor air is being conducted in the indoor heat exchangers 81*a* to 81*e* without excess or deficiency.

Figure 2:
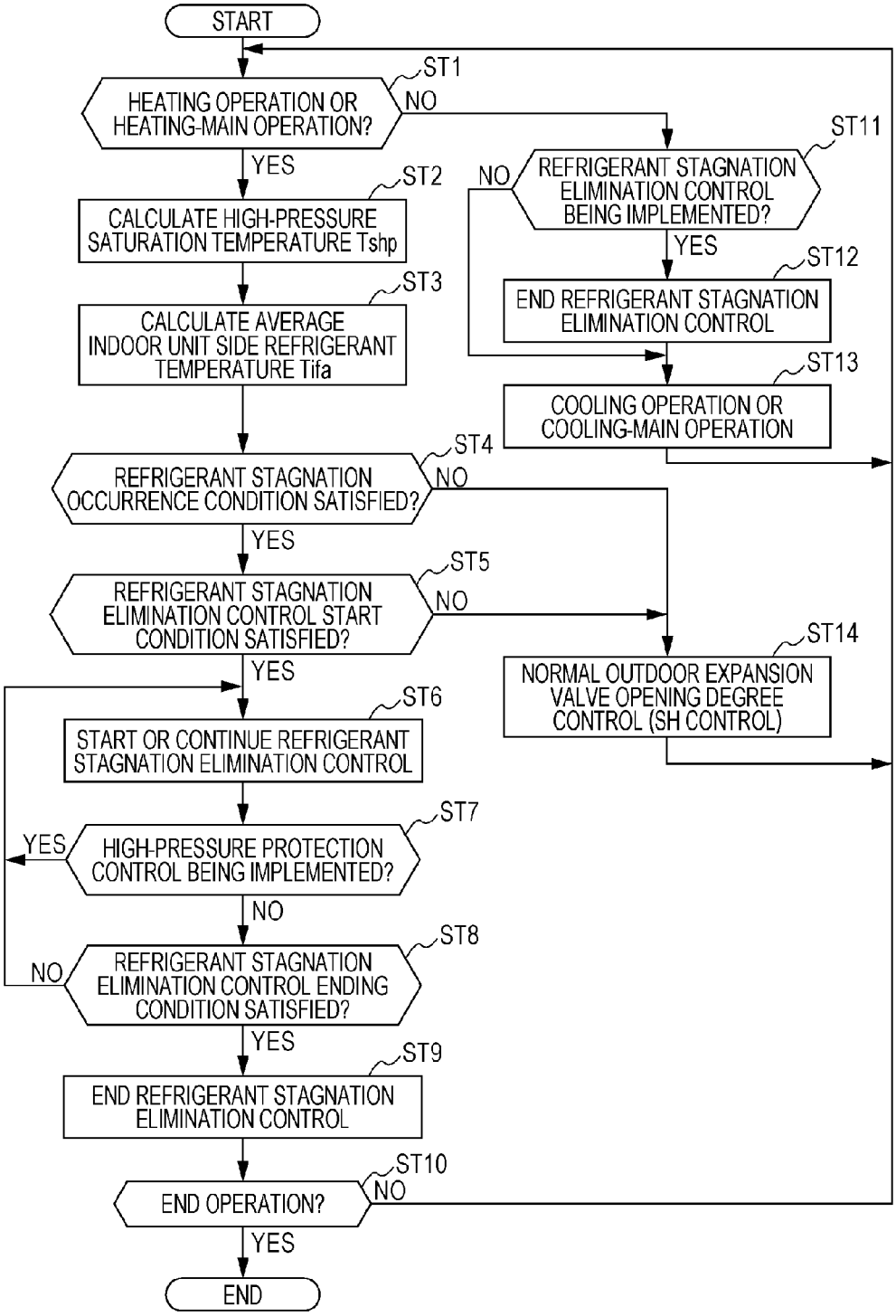
FIG. 2 is a flowchart illustrating a process (refrigerant stagnation elimination control) by a control means according to the embodiment of the present disclosure.

With reference to FIGS. 1 and 2, a process of determining whether the refrigerant stagnation elimination control can be implemented will be described together with an operation of the refrigerant circuit. The CPU 110*a* determines whether heating capacity is ensured when the refrigerant is stagnated in the indoor heat exchangers 81*a* to 81*e*. On the basis of the result of this determination, the CPU 110*a* controls the degree of opening of the first outdoor expansion valves 40*a* and 40*b*, and/or the degree of opening of the second outdoor expansion valves 41*a* and 41*b*.

A flowchart of FIG. 2 illustrates the flow of the process performed by the CPU 110*a*, in which "ST" denotes the step, with the accompanying number denoting the step number. The process illustrated in FIG. 2 is mainly directed to the essential parts of the refrigerant stagnation elimination control. Thus, the description of other general processes, such as the control of the refrigerant circuit in accordance with a temperature set by the user, or operating conditions such as air volume, will be omitted.

First, the CPU 110*a* detects the operation mode and operation capacity required by a user of the indoor units 8*a* to 8*e* from the indoor units 8*a* to 8*e* via the communication unit 130*a*, and then determines whether the heating operation or the heating-main operation is to be performed (ST1).

When the heating operation or the heating-main operation is to be performed (Yes in ST1), the CPU 110*a* switches the first three-way valve 22*a* and/or the second three-way valve 23*a* of the outdoor unit 2*a* so as to perform the heating operation or the heating-main operation. The CPU 110*a* transmits a signal indicating the performing of the heating operation to the CPU 110*b* of the outdoor unit 2*b*. In the following description, it is assumed that all of the indoor units 8*a* to 8*e* depicted in FIG. 1 perform the heating operation.

Specifically, the CPU 110*a* switches the first three-way valve 22*a* so as to provide communication between the port b and the port c. Also, the CPU 110*a* switches the second three-way valve 23*a* so as to provide communication between the port e and the port f (the state indicated by solid line in FIG. 1). Thus, the first outdoor heat exchanger 24*a* and the second outdoor heat exchanger 25*a* serve as evaporators. The CPU 110*a* then causes the compressor 21*a* to be driven at a rotation speed in accordance with the required operation capacity. Also, the CPU 110*a* sets the degree of opening of the first outdoor expansion valve 40*a* to a degree of opening corresponding to the degree of superheat of the refrigerant at the refrigerant exit of the first outdoor heat exchanger 24*a*. The CPU 110*a* sets the degree of opening of the second outdoor expansion valve 41*a* to a degree of opening corresponding to the degree of superheat of the refrigerant at the refrigerant exit of the second outdoor heat exchanger 25*a*.

The degree of superheat of refrigerant can be determined on the basis of the low-pressure saturation temperature calculated on the basis of the pressure detected by the low pressure sensor 51*a*, the refrigerant temperature detected by the first heat exchanger temperature sensor 56*a*, and/or the refrigerant temperature detected by, for example, the second heat exchanger temperature sensor 57*a*. The CPU 110*a* periodically determines the degree of superheat of refrigerant. The CPU 110*a* determines the degree of opening of the first outdoor expansion valve 40*a* and/or the second outdoor expansion valve 41*a* based on the determined degree of superheat of refrigerant.

The CPU 110*b* also receives the signal indicating the performing of the heating operation signal from the CPU 110*a* via the communication unit 130*b*. The CPU 110*b* switches the first three-way valve 22*b* so as to provide communication between the port h and the port j. Also, the CPU 110*b* switches the second three-way valve 23*b* so as to provide communication between the port m and the port n (the state indicated by solid line in FIG. 1). Thus, the first outdoor heat exchanger 24*b* and the second outdoor heat exchanger 25*b* serve as evaporators. The CPU 110*b* then causes the compressor 21*b* to be driven at a rotation speed in accordance with the required operation capacity. Also, the CPU 110*b* sets the degree of opening of the first outdoor expansion valve 40*b* to a degree of opening corresponding to the degree of superheat of refrigerant at the refrigerant exit of the first outdoor heat exchanger 24*b*. The CPU 110*b* also sets the degree of opening of the second outdoor expansion valve 41*b* to a degree of opening corresponding to the degree of superheat of refrigerant at the refrigerant exit of the second outdoor heat exchanger 25*b*.

The degree of superheat of refrigerant can be determined on the basis of the low-pressure saturation temperature calculated on the basis of the pressure detected by the low pressure sensor 51*b*, the refrigerant temperature detected by the first heat exchanger temperature sensor 56*b*, and/or the refrigerant temperature detected by the second heat exchanger temperature sensor 57*b*, for example. The CPU 110*b* determines the degree of superheat of refrigerant periodically, and determines the degree of opening of the first outdoor expansion valve 40*b* and/or the second outdoor expansion valve 41*b* in accordance with the determined degree of superheat of refrigerant.

The control means for the indoor units 8*a* to 8*e* controls the corresponding switching units 6*a* to 6*e* to open the electromagnetic valves 61*a* to 61*e*, whereby the refrigerant is allowed to flow in the first diversion pipes 63*a* to 63*e*. The control means for the indoor units 8*a* to 8*e* also causes the electromagnetic valves 62*a* to 62*e* to be closed, whereby the refrigerant is not permitted to flow in the second diversion pipes 64*a* to 64*e*. Thus, the indoor heat exchangers 81*a* to 81*e* serve as condensers.

After the refrigerant circuit is switched as described above, the air-conditioning apparatus 1 performs the heating operation.

During the heating operation, the CPU 110*a* periodically obtains the high pressure detected by the high-pressure sensor 50*a*. The CPU 110*a* calculates the high-pressure saturation temperature Tshp on the basis of the high pressure (ST2). The CPU 110*a* also periodically obtains the indoor unit side refrigerant temperatures Tif detected by the refrigerant temperature sensors 84*a* to 84*e* from the indoor units 8*a* to 8*e*. On the basis of the indoor unit side refrigerant temperatures Tif, the CPU 110*a* calculates the average indoor unit side refrigerant temperature Tifa (ST3).

Next, the CPU 110*a* determines whether the refrigerant stagnation occurrence condition is satisfied or not (ST4). The refrigerant stagnation occurrence condition includes the degree of subcooling of refrigerant SCs of the air-conditioning apparatus 1 (the first temperature difference) being a predetermined value (such as 13° C.) or more. When this condition is satisfied, it can be suspected that the refrigerant may be stagnated in the indoor heat exchangers 81*a* to 81*e*. The CPU 110*a* calculates the degree of subcooling of refrigerant SCs by subtracting the average indoor unit side refrigerant temperature Tifa from the high-pressure saturation temperature Tshp.

When the refrigerant stagnation occurrence condition is satisfied (Yes in ST4), the CPU 110*a* determines whether the refrigerant stagnation elimination control start condition is satisfied or not (ST5). The refrigerant stagnation elimination control start condition includes, for example, the high-pressure saturation temperature Thsp calculated in ST2 being the first predetermined temperature (such as a target high-pressure saturation temperature) or more, and any of the indoor unit side refrigerant temperatures Tif obtained at the time of calculating the average indoor unit side refrigerant temperature Tifa in ST3 being the second predetermined temperature (such as 35° C.) or less. For example, when the high-pressure saturation temperature Thsp is the target high-pressure saturation temperature or more and any of the indoor unit side refrigerant temperatures Tif is 35° C. or less, it can be considered that the refrigerant stagnation elimination control start condition is satisfied. In this case, it can be suspected that the heating capacity of the indoor units 8*a* to 8*e* provided with the indoor heat exchangers 81*a* to 81*e* in which refrigerant is stagnated may be lacking.

When the refrigerant stagnation elimination control start condition is satisfied (Yes in ST5), the CPU 110*a* starts the refrigerant stagnation elimination control (ST6). During the refrigerant stagnation elimination control, the degree of opening of the first outdoor expansion valve 40*a* and the second outdoor expansion valve 41*a* is increased by a predetermined amount of change, for example. Then, the refrigerant stagnated in the indoor heat exchangers 81*a* to 81*e* is caused to flow out into the accumulator 27*a* through the liquid pipe 32, the liquid branch pipe 32*a*, and the outdoor unit liquid pipe 35*a* and via the first outdoor expansion valve 40*a*, the second outdoor expansion valve 41*a*, the first outdoor heat exchanger 24*a*, and/or the second outdoor heat exchanger 25*a*. Thus, the refrigerant stagnation in the indoor heat exchangers 81*a* to 81*e* can be decreased or eliminated.

As described above, during the refrigerant stagnation elimination control, the degree of opening of the first outdoor expansion valve 40*a* and the second outdoor expansion valve 41*a* is increased by a predetermined amount of change (predetermined rate). Thus, a large amount of the refrigerant stagnated in the indoor heat exchangers 81*a* to 81*e* flows to the outdoor unit 2*a* and/or 2*b*, so that the flow of refrigerant into the compressor 21*a* and/or 21*b* (so-called "liquid-back") can be suppressed. During the increasing of the degree of opening by the predetermined amount of change, the number of pulses given to the first outdoor expansion valve 40*a* and the second outdoor expansion valve 41*a* is increased at the rate of two pulses per 30 seconds, for example. The CPU 110*a* also instructs the CPU 110*b* of the outdoor unit 2*b* to implement the refrigerant stagnation elimination control. In response, the CPU 110*b* similarly increases the degree of opening of the first outdoor expansion valve 40*b* and the second outdoor expansion valve 41*b* at a predetermined amount of change as in the case of the outdoor unit 2*a*.

Next, the CPU 110*a* determines whether high-pressure protection control of the outdoor unit 2*a* and/or 2*b* is being implemented (ST7). The high-pressure protection control is implemented when it is suspected that the high pressure detected by the high-pressure sensor 50*a* and/or 50*b* may exceed an upper-limit value of the discharge pressure for the compressor 21*a* and/or 21*b*. The high-pressure protection control includes, for example, decreasing the rotation speed of the compressor 21*a* and/or 21*b*, or permitting the refrigerant and/or refrigerating machine oil to flow in the hot gas bypass pipe 36*a*, the hot gas bypass pipe 36*b*, the oil return pipe 37*a*, and/or the oil return pipe 37*b* by opening the first electromagnetic valve 42*a*, the first electromagnetic valve 42*b*, the second electromagnetic valve 43*a*, and/or the second electromagnetic valve 43*b*.

By those methods, it becomes possible to decrease the discharge pressure of the compressor 21*a* and/or 21*b*. While a detailed description is omitted, the high-pressure protection control may be implemented when the high pressure detected by the high-pressure sensor 50*a* and/or 50*b* becomes a predetermined pressure or more, that is determined in advance experimentally, for example. The high-pressure protection control may be ended when the high pressure detected by the high-pressure sensor 50*a* and/or 50*b* becomes lower than the predetermined pressure that is determined in advance experimentally, for example. Namely, the high-pressure protection control may be implemented irrespective of the refrigerant stagnation elimination control according to the present embodiment.

When the high-pressure protection control is implemented, the high pressure is also decreased as a result of the decrease in the discharge pressure of the compressor 21*a* and/or 21*b*. As the high pressure is decreased, the high-pressure saturation temperature Tshp, which is calculated on the basis of the high pressure, is also decreased. In this case, the determination as to whether the refrigerant stagnation elimination control ending condition is satisfied or not may be erroneously made in the process of ST8 which will be described later. If the determination as to whether the refrigerant stagnation elimination control ending condition is satisfied or not is erroneously made, the refrigerant stagnation elimination control may be ended when in fact the refrigerant stagnation elimination control should be continued.

Thus, if the high-pressure protection control is being implemented when the refrigerant stagnation elimination control is being implemented (Yes in ST7), the CPU 110*a* returns the process to ST6 and continues the refrigerant stagnation elimination control.

If the high-pressure protection control is not being implemented when the refrigerant stagnation elimination control is being implemented (No in ST7), the CPU 110*a* determines whether the refrigerant stagnation elimination control ending condition is satisfied or not (ST8). The refrigerant stagnation elimination control ending condition includes, for example, the high-pressure saturation temperature Thsp calculated in ST2 being lower than the first predetermined temperature (such as the target high-pressure saturation temperature), and all of the indoor unit side refrigerant temperatures Tif obtained when calculating the average indoor unit side refrigerant temperature Tifa in ST3 being higher than the second predetermined temperature (such as 35° C.). For example, when the high-pressure saturation temperature Thsp is lower than the target high-pressure saturation temperature and all of the indoor unit side refrigerant temperatures Tif are higher than 35° C., it can be considered that the refrigerant stagnation elimination control ending condition is satisfied. In this case, it may be considered that the lack of heating capacity in the indoor units 8*a* to 8*e* provided with the indoor heat exchangers 81*a* to 81*e* has been mitigated or eliminated.

When the refrigerant stagnation elimination control ending condition is not satisfied (No in ST8), the CPU 110*a* returns the process to ST6 and continues the refrigerant stagnation elimination control. When the refrigerant stagnation elimination control ending condition is satisfied (Yes in ST8), the CPU 110*a* ends the refrigerant stagnation elimination control in the outdoor unit 2*a* (ST9). The CPU 110*a* also instructs the CPU 110*b* of the outdoor unit 2*b* to end the refrigerant stagnation elimination control. In response, the CPU 110*b* ends the refrigerant stagnation elimination control in the outdoor unit 2*b*.

Next, the CPU 110*a* determines whether the operation of the outdoor units 2*a* and 2*b* is to be ended as a result of ending of the operation of all of the indoor units 8*a* to 8*e* (ST10). When the operation is to be ended (Yes in ST10), the CPU 110*a* stops the compressor 21*a* and causes the first outdoor expansion valve 40*a* and the second outdoor expansion valve 41*a* to be fully closed, and ends the process. The CPU 110*a* instructs the CPU 110*b* to end the operation of the outdoor unit 2*b*. In response, the CPU 110*b* stops the compressor 21*b* and causes the first outdoor expansion valve 40*b* and the second outdoor expansion valve 41*b* to be fully closed.

When the operation of the outdoor units 2*a* and 2*b* is not to be ended (No in ST10), the CPU 110*a* returns the process to ST1.

When the heating operation or the heating-main operation is not performed in ST1 (No in ST1), the CPU 110*a* determines whether the refrigerant stagnation elimination control is being implemented (ST11). This determination is made when, for example, the operation of the air-conditioning apparatus 1 is switched from the heating operation or the heating-main operation to the cooling operation or the cooling-main operation. When the refrigerant stagnation elimination control is not being implemented (No in ST11), the CPU 110*a* advances the process to ST13. When the refrigerant stagnation elimination control is being implemented (Yes in ST11), the CPU 110*a* ends the refrigerant stagnation elimination control in the outdoor unit 2*a* (ST12) and advances the process to ST13. At this time, the CPU 110*a* instructs the CPU 110*b* of the outdoor unit 2*b* to end the refrigerant stagnation elimination control. In response, the CPU 110*b* ends the refrigerant stagnation elimination control in the outdoor unit 2*b*.

In ST13, the CPU 110*a* switches the first three-way valve 22*a* and the second three-way valve 23*a* of the outdoor unit 2*a* to perform the cooling operation or the cooling-main operation. Also, the CPU 110*a* transmits a signal indicating the performing of the cooling operation or the cooling-main operation to the CPU 110*b* of the outdoor unit 2*b*. Specifically, the CPU 110*a* switches the first three-way valve 22*a* so as to provide communication between the port a and the port b. The CPU 110*a* also switches the second three-way valve 23*a* so as to provide communication between the port d and the port e (the state indicated by broken line in FIG. 1). Thus, the first outdoor heat exchanger 24*a* and the second outdoor heat exchanger 25*a* serve as condensers. The CPU 110*a* then causes the compressor 21*a* to be driven at a rotation speed in accordance with the required operation capacity. Also, the CPU 110*a* sets the degree of opening of the first outdoor expansion valve 40*a* to full-open or a degree of opening corresponding to the degree of subcooling of refrigerant at the refrigerant exit of the first outdoor heat exchanger 24*a*. The CPU 110*a* sets the degree of opening of the second outdoor expansion valve 41*a* to full-open or a degree of opening corresponding to the degree of subcooling of refrigerant at the refrigerant exit of the second outdoor heat exchanger 25*a*.

The CPU 110*b* also receives the signal indicating the performing of the cooling operation or the cooling-main operation from the CPU 110*a* via the communication unit 130*b*. Thus, the CPU 110*b* switches the first three-way valve 22*b* and the second three-way valve 23*b* of the outdoor unit 2*b* to perform the cooling operation or the cooling-main operation. Specifically, the first three-way valve 22*b* is switched so as to provide communication between the port g and the port h. Also, the second three-way valve 23*b* is switched so as to provide communication between the port k and the port m (the state indicated by broken line in FIG. 1). Thus, the first outdoor heat exchanger 24*b* and the second outdoor heat exchanger 25*b* serve as condensers. The CPU 110*b* then causes the compressor 21*b* to be driven at a rotation speed in accordance with the required operation capacity. The CPU 110*b* also sets the degree of opening of the first outdoor expansion valve 40*b* to full-open or a degree of opening corresponding to the degree of subcooling of refrigerant at the refrigerant exit of the first outdoor heat exchanger 24*b*. The CPU 110*b* sets the degree of opening of the second outdoor expansion valve 41*b* to full-open or a degree of opening corresponding to the degree of subcooling of refrigerant at the refrigerant exit of the second outdoor heat exchanger 25*b*.

The control means for the indoor units 8*a* to 8*e* controls the corresponding switching units 6*a* to 6*e* so as to close the electromagnetic valves 61*a* to 61*e*. Thus, the flow of refrigerant in the first diversion pipes 63*a* to 63*e* is prevented. Also, the control means for the indoor units 8*a* to 8*e* controls the corresponding switching units 6*a* to 6*e* so as to open the electromagnetic valves 62*a* to 62*e*. Thus, the flow of refrigerant in the second diversion pipes 64*a* to 64*e* is permitted. As a result, the indoor heat exchangers 81*a* to 81*e* serve as evaporators.

After the refrigerant circuit is switched as described above, the air-conditioning apparatus 1 performs the cooling operation or the cooling-main operation. After the process of ST13, the CPU 110*a* returns the process to ST1.

When the refrigerant stagnation occurrence condition is not satisfied in ST4 (No in ST4), or the refrigerant stagnation elimination control start condition is not satisfied in ST5 (No in ST5), the CPU 110*a* performs the following process. Namely, the CPU 110*a* performs the normal opening degree control for the first outdoor expansion valve 40*a* and/or the second outdoor expansion valve 41*a* (the opening degree control in accordance with the degree of superheat of refrigerant at the refrigerant exit of the first outdoor heat exchanger 24*a* and/or the second outdoor heat exchanger 25*a*; ST14), and then returns the process to ST1. The CPU 110*a* also transmits to the CPU 110*b* of the outdoor unit 2*b* a signal indicating that the opening degree control for the individual outdoor expansion valves is performed by normal control. Upon reception of the signal via the communication unit 130*b*, the CPU 110*b* performs the normal opening degree control for the first outdoor expansion valve 40*b* and/or the second outdoor expansion valve 41*b* (the opening degree control in accordance with the degree of superheat of refrigerant at the refrigerant exit of the first outdoor heat exchanger 24*b* and/or the second outdoor heat exchanger 25*b*).

As described above, in the air-conditioning apparatus according to the present disclosure, when, during the heating operation or the heating-main operation of the air-conditioning apparatus, refrigerant is stagnated in the indoor heat exchanger of an indoor unit performing the heating operation, it is determined whether the heating capacity of the indoor unit performing the heating operation is lowered by the stagnation of the refrigerant in the indoor heat exchanger (whether the refrigerant stagnation affects the heating capacity of the indoor unit). Then, in the air-conditioning apparatus according to the present disclosure, the refrigerant stagnation in the indoor heat exchangers can be eliminated as needed. In other words, when it is determined that the heating capacity is lowered, the refrigerant stagnation elimination control is implemented. Thus, the refrigerant stagnation in the indoor heat exchanger of the indoor unit performing the heating operation can be mitigated or eliminated. As a result, the heating capacity of the indoor unit performing the heating operation can be ensured.

In the foregoing embodiment, the air-conditioning apparatus in which five indoor units are coupled in parallel to two outdoor units via the high-pressure gas pipe, the low-pressure gas pipe, and the liquid pipes and that can perform the cooling/heating-free operation has been described by way of example. However, the present disclosure may also be applied to a so-called multi-type air-conditioning apparatus provided with at least one outdoor unit and a plurality of indoor units coupled in parallel to the outdoor unit via a gas pipe and a liquid pipe, in which all of the indoor units can perform the cooling operation or the heating operation simultaneously. The present disclosure may also be applied to an air-conditioning apparatus provided with one outdoor unit and one indoor unit coupled to the outdoor unit.

The air-conditioning apparatus according to the present disclosure may be the first to third air-conditioning apparatuses as follows. The first air-conditioning apparatus includes: at least one outdoor unit including a compressor, an outdoor heat exchanger, a flow passage switching means coupled to one refrigerant exit/entry of the outdoor heat exchanger and configured to switch the coupling of the outdoor heat exchanger to a refrigerant discharge opening or a refrigerant suction opening of the compressor, an outdoor unit flow rate adjustment means coupled to another refrigerant exit/entry of the outdoor heat exchanger and configured to adjust the flow rate of refrigerant in the outdoor heat exchanger, and a control means configured to control the flow passage switching means and the flow rate adjustment means; and a plurality of indoor units coupled to the outdoor unit via a liquid pipe and at least one gas pipe and each including an indoor heat exchanger, and an indoor unit flow rate adjustment means coupled to one refrigerant exit/entry of the indoor heat exchanger and configured to adjust the flow rate of refrigerant in the indoor heat exchanger. The outdoor unit flow rate adjustment means and the indoor unit flow rate adjustment means are coupled via the liquid pipe. A refrigerant pipe configured to couple the indoor unit flow rate adjustment means and the indoor heat exchanger is provided with an indoor unit side refrigerant temperature detection means. A refrigerant pipe coupled to the discharge side of the compressor is provided with a high pressure detection means configured to detect the pressure of the refrigerant flowing in the refrigerant pipe. When the flow passage switching means is controlled such that the outdoor heat exchanger is caused to serve as an evaporator, and when the temperature difference between a high-pressure saturation temperature calculated by using the pressure obtained from the high pressure detection means and an average indoor unit side refrigerant temperature which is an average value of the refrigerant temperatures obtained from the indoor unit side refrigerant temperature detection means corresponding to the indoor heat exchangers serving as condensers is a predetermined value or more, the control means determines that the refrigerant is stagnated in at least one of the indoor heat exchangers. When it is determined that refrigerant is stagnated in at least one of the indoor heat exchangers, the control means determines that the heating capacity is lacking in the indoor unit with the indoor heat exchanger in which the refrigerant is stagnated when the high-pressure saturation temperature is a first predetermined temperature or more and when at least one of the refrigerant temperatures obtained from the indoor unit side refrigerant temperature detection means is a second predetermined temperature or less.

The second air-conditioning apparatus is such that, in the first air-conditioning apparatus, the control means, upon determining that the heating capacity is lacking in the indoor unit with the indoor heat exchanger in which the refrigerant is stagnated, performs refrigerant stagnation elimination control so as to cause the refrigerant stagnated in the indoor heat exchanger to flow out of the indoor heat exchanger.

The third air-conditioning apparatus is such that, in the second air-conditioning apparatus, the refrigerant stagnation elimination control causes the degree of opening of the outdoor unit flow rate adjustment means to be increased by a predetermined amount of change.

According to the above air-conditioning apparatuses, when the outdoor heat exchanger is caused to serve as an evaporator, i.e., during the heating operation or the heating-main operation, if the refrigerant is stagnated in the indoor heat exchanger of the indoor unit performing the heating operation, it is determined whether the heating capacity is decreased in the indoor unit performing the heating operation. When it is determined that the heating capacity is decreased, the refrigerant stagnation elimination control is implemented so as to eliminate the refrigerant stagnation in the indoor heat exchanger of the indoor unit performing the heating operation. Thus, the refrigerant stagnation in the indoor heat exchanger can be eliminated as needed, whereby the heating capacity in the indoor unit performing the heating operation can be ensured.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An air-conditioning apparatus, comprising:

a plurality of indoor units, each of the indoor units comprising an indoor heat exchanger;

an outdoor unit comprising an outdoor heat exchanger, a compressor and a control unit configured to determine whether stagnation of refrigerant in the indoor heat exchanger lowers heating capacity of the indoor unit performing a heating operation; and a refrigerant pipe configured to couple the outdoor heat exchanger and the compressor with each of the indoor units, wherein the outdoor unit further comprises a high-pressure sensor that is disposed at the refrigerant pipe coupling the compressor with the each of the indoor units, the high-pressure sensor configured to detect a pressure of refrigerant that flows from the compressor to the indoor heat exchanger, each of the indoor units further comprises a refrigerant temperature sensor that is disposed at the refrigerant pipe coupling the indoor heat exchanger with the outdoor heat exchanger, the refrigerant temperature sensor configured to detect an indoor unit side refrigerant temperature of the refrigerant that is flowed out from the indoor heat exchanger, and the control unit is configured to:

calculate a high-pressure saturation temperature based on the pressure detected by the high-pressure sensor;

calculate an average indoor unit side refrigerant temperature based on the indoor unit side refrigerant temperatures detected by each of the refrigerant temperature sensors, determine that the stagnation of the refrigerant in the indoor heat exchanger lowers the heating capacity of the indoor unit performing a heating operation when a temperature difference between the high-pressure saturation temperature and the average indoor unit side refrigerant temperature is a predetermined value or more, the high-pressure saturation temperature is a first predetermined temperature or more and the indoor unit side refrigerant temperature detected by at least one of the refrigerant temperature sensors is a second predetermined temperature or less; and perform refrigerant stagnation elimination control when the control unit determines that the stagnation of the refrigerant in the indoor heat exchanger lowers the heating capacity of the indoor unit performing the heating operation.

2. The air-conditioning apparatus according to claim 1, wherein the outdoor unit further comprises a flow rate adjustment unit configured to adjust the flow rate of the refrigerant flowing in the refrigerant pipe, and the control unit increases the flow rate of the refrigerant from the indoor heat exchanger by controlling the flow rate adjustment unit during the refrigerant stagnation elimination control.

3. The air-conditioning apparatus according to claim 2, wherein the flow rate adjustment unit is an expansion valve.

4. The air-conditioning apparatus according to claim 3, wherein the control unit increases the flow rate of the refrigerant from the indoor heat exchanger by increasing the degree of opening of the expansion valve by a predetermined amount of change during the refrigerant stagnation elimination control.

* * * * *